United States Patent [19]

Graafsma et al.

[11] 4,015,825

[45] Apr. 5, 1977

[54] TILTABLE JACK

[75] Inventors: Richard S. Graafsma, Benton Harbor; R. Harlan Nehrig, Stevensville, both of Mich.

[73] Assignee: Auto Specialties Manufacturing Company, St. Joseph, Mich.

[22] Filed: Jan. 28, 1976

[21] Appl. No.: 653,096

[52] U.S. Cl. ..... 254/101; 254/DIG. 1

[51] Int. Cl.[2] ..... B66F 13/00

[58] Field of Search ..... 254/101, DIG. 1

[56] References Cited

UNITED STATES PATENTS

| | | | |
|---|---|---|---|
| 1,268,410 | 6/1918 | Weber | 254/101 |
| 1,810,657 | 6/1931 | Kohler | 254/101 |
| 1,810,667 | 6/1931 | Larson et al. | 254/101 |
| 3,881,692 | 5/1975 | Clarke | 254/101 |

FOREIGN PATENTS OR APPLICATIONS

| | | | |
|---|---|---|---|
| 817,338 | 7/1959 | United Kingdom | 254/101 |

*Primary Examiner*—James L. Jones, Jr.
*Assistant Examiner*—Robert C. Watson
*Attorney, Agent, or Firm*—Olson, Trexler, Wolters, Bushnell & Fosse, Ltd.

[57] ABSTRACT

A tiltable jack is provided. A cylindrical pivot pin is disposed between a jack housing and a base member. A bowed leaf spring urges the jack housing toward and into an upright position. Tangs on the spring and abutments on the base member retain the pivot pin in a desired location.

27 Claims, 5 Drawing Figures

TILTABLE JACK

BACKGROUND OF THE INVENTION

This invention relates generally to jacks or lifting devices for vehicles and the like and more particularly concerns a jack having a housing which can be safely tilted or tipped relative to a jack base member.

Jacks having housings which can be tipped or tilted relative to their base members have previously been offered to accommodate bending loads or side loads applied to the jack. These loads can be encountered under a number of conditions such as those involved when a load is to be lifted from a relatively low position to a relatively elevated position through an arcuate path, and when the center of this path arc is located relatively close to the jack itself. To safely accommodate such conditions, tiltable jacks such as that described in U.S. Pat. No. 3,881,692 have been offered. At least some of these jacks reduce the bending load or side load applied to the jack column or screw elements during jack use. Side load reduction results in improved service life. Reduction of side load can also result in improved jack load-lifting ability. Handle or jack operating effort is also reduced. Further, jack stability can be improved under some conditions.

It is the general object of the present invention to provide such a tiltable jack at low finished cost in which the mechanism permitting jack tilting is a relatively small element of jack cost.

Another object of the invention is to provide such a jack in which the mechanism permitting jack tilting is relatively frictionless. An associated object is to provide such a jack in which the jack tilting mechanism requires little or no lubrication. A correlated object is to provide a jack tilting mechanism which is relatively unaffected by dirt, grit, or other environmental conditions in which the jack can be used.

Yet another object is to provide a tiltable jack in which the jack tilt mechanism urges the jack housing toward and into an upright position relative to the base.

Yet another object is to provide such a jack which requires but few parts.

A further object is to provide a tiltable jack which is reliable and rugged in operation. A related object is to provide such a jack which can confidently be expected to enjoy a long service life.

Other objects and advantages of the invention will become apparent upon reading the following detailed description and upon reference to the drawings. Throughout the drawings, like reference numerals refer to like parts.

DETAILED DESCRIPTION

Figure 1:
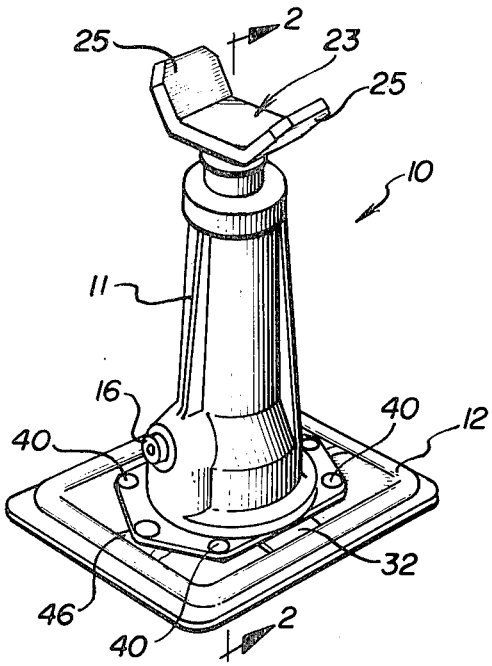
FIG. 1 is a perspective view showing in its general aspect a jack embodying the present invention.

While the invention will be described in connection with a preferred embodiment, it will be understood that it is not intended to limit the invention to this embodiment. On the contrary, it is intended to cover all alternatives, modifications and equivalents as may be included within the spirit and scope of the invention as defined by the appended claims.

Turning more particularly to the drawings, there is shown in FIGS. 1–4 a resiliently tiltable jack 10 embodying the present invention. This jack can be considered to include a housing member 11 which is supported upon a base plate 12. One or more screw members 13 and 14 are carried at least partly within the housing 11, and are arranged for extensible and retractible motion relative to the housing 11. This screw member motion is caused by appropriate rotation of a pinion gear 16 which turns a crown gear 17. Easy jack operation is promoted by mounting the crown gear 17 upon a bearing 19 carried by a jack housing bottom plate 20.

A jack head 23 is connected to the upper portion of the screw member 13, and is adapted to engage a load 24. Although the load engaging member 23 can be of any effective shape, the one illustrated here is provided with upwardly extending arms 25 adapted to maintain the jack head 23 and load 24 in contact as the load is lifted to an elevated position.

Now, it will be understood that if another portion of the load rests immobile upon the ground or some other fixed surface, this lifted portion of the load 24 will pivot about that immobile point as lifting motion occurs, and the load 24 will consequently move through an arcuate path to an elevated position. As it moves through this arcuate path, or under other conditions, side forces may be imparted to the jack 10 which urge the jack housing and screw members to tip or tilt.

Figure 2:
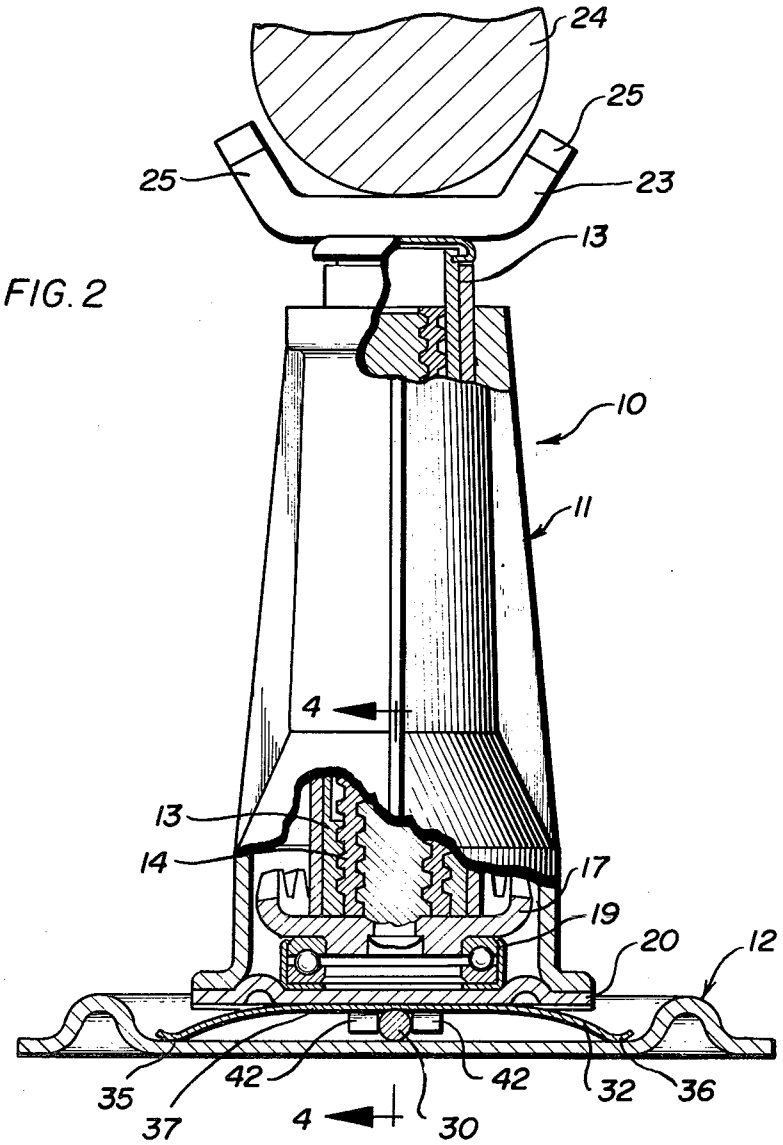
FIG. 2 is a sectional view taken substantially in the plane of line 2—2 in FIG. 1 and showing portions of the jack including the jack tilting mechanism as it appears when the jack is in its upright condition.

In accordance with the invention, tipping or tilting motion imparted to the jack housing 11 is accommodated by a pivot pin 30 disposed between the base member 12 and the housing 11, by pivot pin retaining means 31 more fully described below, and by a resilient spring 32 posed between the jack housing 11 and the base member 12 so as to urge the jack housing 11 toward and into the upright position relative to the base member 12 as illustrated in FIG. 2.

Figure 5:
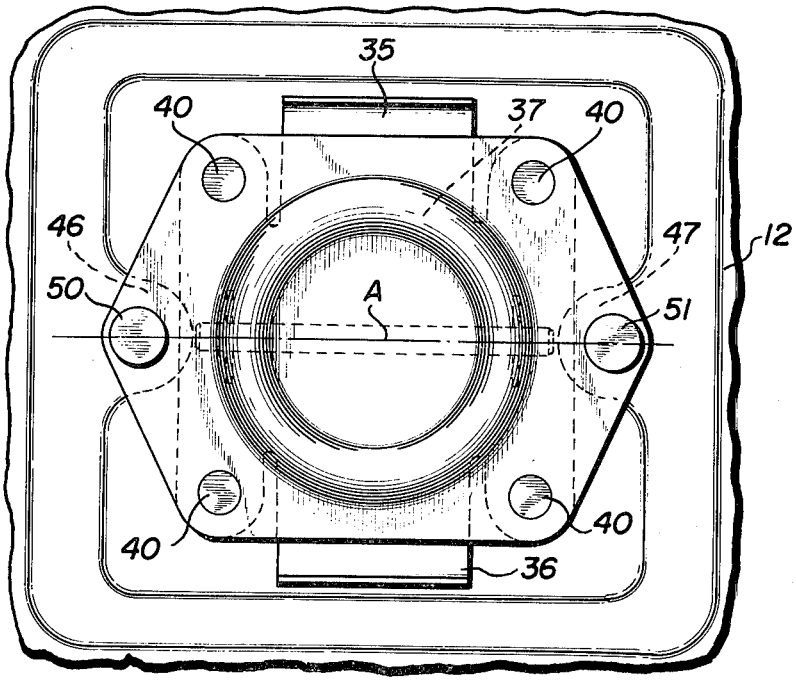
FIG. 5 is a sectional view taken substantially in the plane of line 5—5 in FIG. 4 and showing in yet further detail the jack tilt mechanism.
Figure 3:
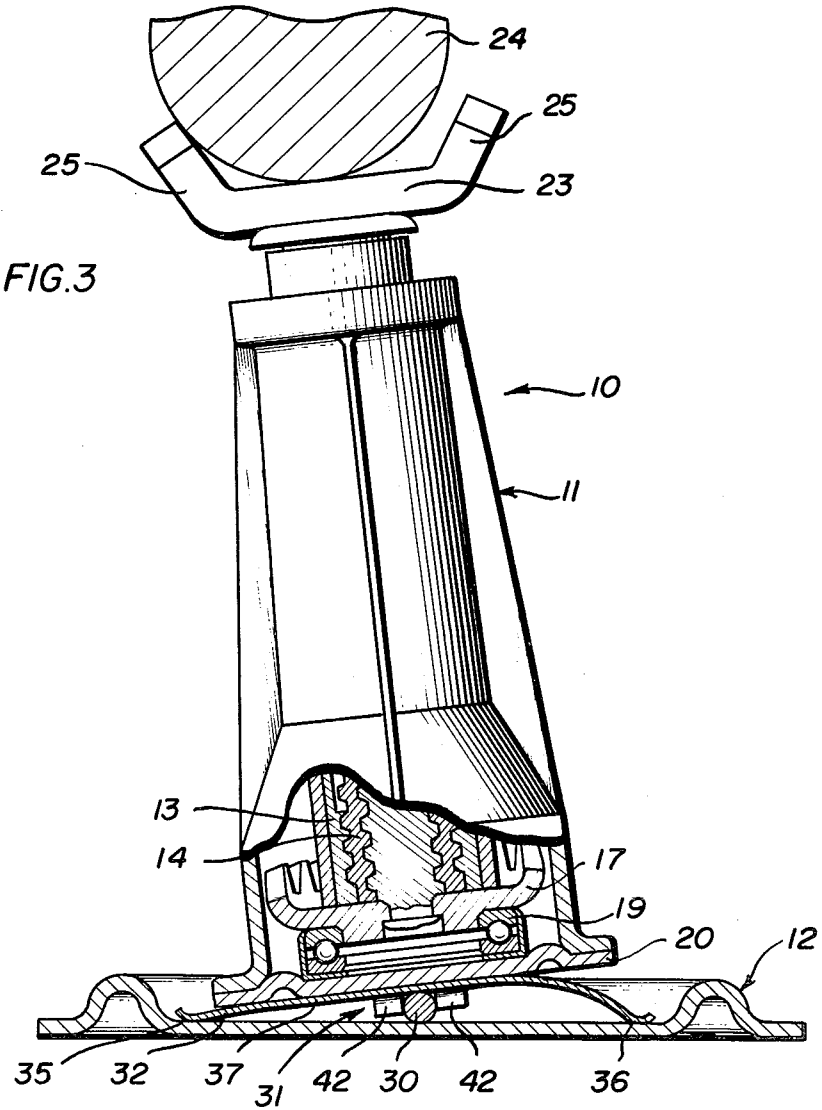
FIG. 3 is an elevational view similar to FIG. 2 and taken in the plane of line 2—2 in FIG. 1 but showing the jack in its tilted condition.

It is a feature of the invention that the resilient spring member 32 is of low cost, yet it urges the jack housing member 11 to pivot or tilt in but a single plane of motion. To this end, the resilient member here comprises a bowed leaf spring, and includes two oppositely disposed ends 35 and 36 which press upon the jack base member 12 along two parallel lines of contact, as may be envisioned from FIGS. 2, 3 and 5. A mediate spring portion 37 engages the bottom plate 20 of the jack housing 11 throughout an area of contact. Here, this area of bottom plate-spring contact is made secure by positively affixing the leaf spring mediate portion 37 to the jack housing bottom plate 20 by four rivets 40 as illustrated in FIG. 5.

To inhibit motion of the cylindrical pivot pin 30 in a radial direction, in accordance with one feature of the invention, the pivot pin retaining means 31 includes a number of small tangs 42 which depend from the spring mediate portion 37. Pin placement security is encouraged by locating at least two tangs on opposite sides of the pivot pin 30 at each pin end 43 and 44, as can be envisioned from FIGS. 2, 3 and 4. Manufacturing costs can be minimized by forming these tangs 42 from the leaf spring mediate portion material; they can be partially struck or turned out of the plane of the mediate spring if desired.

Figure 4:
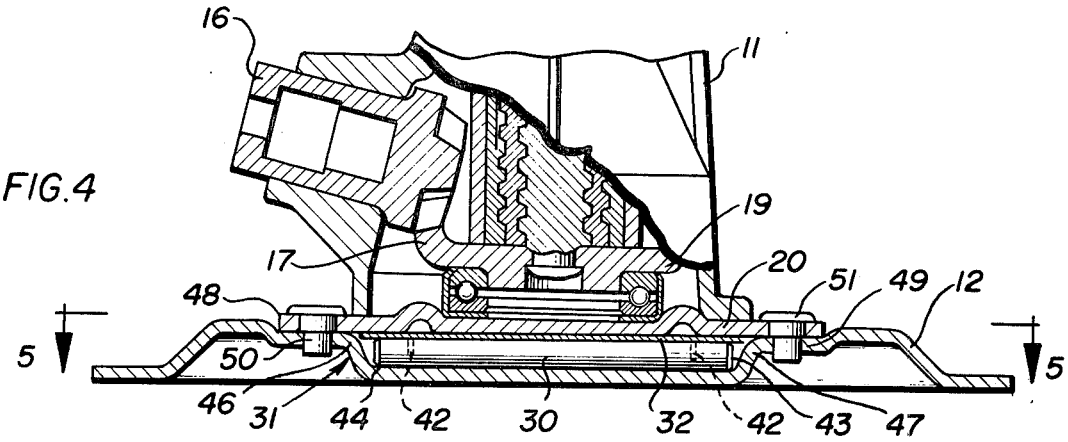
FIG. 4 is a fragmentary sectional view taken substantially in the plane of line 4—4 in FIG. 2 and showing in further detail the jack tilt mechanism.

To inhibit motion of the pin 30 in an axial direction in further accordance with this feature of the invention, the base plate 12 includes two oppositely disposed abutment formations 46 and 47 as illustrated in FIG. 4. If the base plate 12 is formed of sheet metal, these abutments 46 and 47 can be formed at little cost by known stamping methods. Each abutment 46 and 47 is formed with a rounded top portion 48 and 49, respectively, to permit tipping motion of the jack housing 11 and the associated bottom plate 20 relative to the stationary base plate member 12.

Disconnection of the jack housing member 11 from the base plate 12 and substantial housing-base relative translational motion are prohibited by two peg members 50 and 51, which are disposed in line with the extended axis A of the pivot pin 30. These pegs loosely interconnect the housing bottom plate 20 with the base plate 12.

When the invention is constructed as described here, the pivot pin 30 is prohibited from any substantial motion relative to the jack housing 11, the leaf spring 32, or the base plate 12. However, relatively frictionless tipping motion is permitted because the cylindrical pin 30 provides two diametrically oppositely disposed but parallel lines of pin-jack contact: a first line between the leaf spring, and a second line between the pivot pin and base plate. These contact lines are oriented parallel to the lines of leaf spring-base member contact so as to encourage jack tipping in a single plane of motion. In addition, no tilting mechanism lubrication will be necessary. However, easy pivoting operation is assured and long jack life is encouraged since dirt and like foreign substances will have little effect upon the mechanism.

The invention is claimed as follows:

1. A tiltable jack comprising a jack housing member, a base member adapted to support the jack, a pivot pin disposed between the base member and the housing member and tiltably supporting the jack housing member on the base member, a bowed leaf spring disposed between the jack housing member and the base member for urging the jack housing member toward and into an upright position relative to the base member and pivot pin retaining means including a plurality of tangs depending from the leaf spring for retaining the pivot pin between the jack housing member and base member.

2. A jack according to claim 1 wherein said bowed leaf spring engages one of the jack housing and base members along two parallel lines of contact and the other of the jack housing and base members throughout an area of contact at a mediate spring portion to encourage jack tipping in but a single plane of motion.

3. A jack according to claim 2 wherein said bowed leaf spring includes two oppositely disposed ends contacting said jack base member along said two parallel lines of contact and a mediate portion engaging said jack housing member throughout an area of contact.

4. A jack according to claim 1 wherein said tangs are formed from material comprising the leaf spring mediate portion but turned out of the plane of said mediate portion to retentively and abuttively engage said pivot pin.

5. A jack according to claim 1 wherein said tangs include at least two tangs located on opposite sides of said pivot pin at each end of said pin.

6. A jack according to claim 2 wherein said pivot pin is cylindrical to provide a first line of contact between the pivot pin and the housing member and a second line of contact between the pivot pin and the base member, the two lines of contact being parallel to one another and parallel to the lines of leaf spring-member contact so as to encourage jack tipping in said single plane of jack motion.

7. A jack according to claim 1 including a screw member extensible from and retractible at least partially into said jack housing member.

8. A jack according to claim 7 including a jack head connected to said screw member and adapted to engage a load and lift the load to an elevated position while accommodating a jack side load, thereby urging the jack housing to tip relative to said jack base member as said screw member is extended and said lifting member is elevated.

9. A jack according to claim 1 wherein said jack pivot pin retaining means includes two peg members disposed in line with the extended axis of said pivot pin and loosely connecting said jack housing member to said base member so as to prohibit substantial translational motion of one member relative to the other, but to permit tipping motion of one member relative to the other.

10. A jack according to claim 1 including jack pivot pin retaining means having abutment means formed upon one of said member at opposite ends of said pivot pin to prevent substantial motion of the pivot pin in its axial direction.

11. A resiliently tiltable jack comprising, in combination a jack housing member, a base member adapted to solidly support the jack, a pivot pin disposed between the base member and the jack housing, pivot pin retaining means for retaining the pivot pin in a predetermined location between the jack housing member and the base member, a bowed, bi-ended resilient leaf spring having a mediate portion abuttively engaging one of the members and opposite ends contacting the other member along parallel lines of contact on opposite sides of the pivot pin, and peg means disposed on opposite sides of the jack in line with the extended axis of the pivot pin and loosely connecting the jack housing member to the base member so as to prohibit substantial translational motion of one member relative to the other member but to permit limited tipping motion of one member relative to the other member.

12. A jack according to claim 1 including means for affixing said leaf spring mediate portion to one of said members.

13. A jack according to claim 12 including a plurality of rivet members for affixing said leaf spring mediate portion to said jack housing.

14. A jack according to claim 11 wherein said retainer means includes a plurality of tangs depending from said leaf spring mediate portion and disposed on opposite sides of said pivot pin.

15. A jack according to claim 14 including at least four tangs, two tangs being disposed at each end of said pivot pin upon opposite pivot pin sides.

16. A jack according to claim 11 wherein said retainer means includes abutment means formed on one member at opposite ends of said pivot pin to prevent substantial motion of the pivot pin in its axial direction.

17. A jack according to claim 16 including two abutments formed on said base member.

18. A jack according to claim 17 wherein said abutments are formed with top portions, said peg means being connected to said base member through said abutment top portions.

19. A jack according to claim 18 wherein said abutment top portions include rounded surfaces to permit tipping motion of said jack housing member relative to said base member.

20. A tiltable jack comprising a jack housing member, a base member adapted to solidly support the jack, a pivot pin disposed between the base member and the housing member and tiltably supporting the jack housing member on the base member, pivot pin retaining means including abutment means formed upon one of such members at opposite ends of the pivot pin to prevent substantial motion of the pin in its axial direction, and resilient means disposed between the jack housing member and the base member for urging the jack housing member toward and into an upright position relative to the base member.

21. A jack according to claim 20 wherein said resilient means comprises a bowed leaf spring engaging one of the jack housing and base members along two parallel lines of contact and the other of the jack housing and base members throughout an area of contact at a mediate spring portion to encourage jack tipping in but a single plane of motion.

22. A jack according to claim 21 wherein said bowed leaf spring includes two oppositely disposed ends contacting said jack base member along said two parallel lines of contact and a mediate portion engaging said jack housing member throughout an area of contact.

23. A jack according to claim 22 wherein said pivot pin retaining means includes a plurality of tangs depending from the leaf spring mediate portion.

24. A jack according to claim 23 wherein said tangs are formed from material comprising the leaf spring mediate portions but turned out of the plane of said mediate portion to retentively and abuttively engage said pivot pin.

25. A jack according to claim 23 wherein said tangs include at least two tangs located on opposite sides of said pivot pin at each end of said pin.

26. A jack according to claim 21 wherein said pivot pin is cylindrical to provide two diametrically oppositely disposed but parallel lines of contacts oriented parallel to the lines of leaf spring-member contact so as to encourage jack tipping in said single plane of jack motion.

27. A jack according to claim 20 wherein said jack pivot pin retaining means includes two peg members disposed in line with the extended axis of said pivot pin and loosely connecting said jack housing member to said base member so as to prohibit substantial translational motion of one member relative to the other, but to permit tipping motion of one member relative to the other.

* * * * *